US010278478B2

(12) United States Patent
Sanchez et al.

(10) Patent No.: US 10,278,478 B2
(45) Date of Patent: May 7, 2019

(54) APPLICATOR FOR APPLYING A PRODUCT TO THE EYELASHES AND/OR EYEBROWS

(71) Applicant: L'OREAL, Paris (FR)

(72) Inventors: Marcel Sanchez, Aulney Sous Bois (FR); Eric Caulier, Maignelay (FR); Audrey Thenin, Meudon (FR)

(73) Assignee: L'OREAL, Paris (FR)

( * ) Notice: Subject to any disclaimer, the term of this patent is extended or adjusted under 35 U.S.C. 154(b) by 115 days.

(21) Appl. No.: 14/896,585

(22) PCT Filed: Jun. 6, 2014

(86) PCT No.: PCT/IB2014/062007

§ 371 (c)(1),
(2) Date: Dec. 7, 2015

(87) PCT Pub. No.: WO2014/195912

PCT Pub. Date: Dec. 11, 2014

(65) Prior Publication Data

US 2016/0128449 A1 May 12, 2016

(30) Foreign Application Priority Data

Jun. 6, 2013 (FR) ..... 13 55190

(51) Int. Cl.
*A45D 40/26* (2006.01)
*A46B 1/00* (2006.01)
*A46B 9/02* (2006.01)

(52) U.S. Cl.
CPC ..... *A45D 40/265* (2013.01); *A46B 1/00* (2013.01); *A46B 9/021* (2013.01); *A46B 9/028* (2013.01); *A46B 2200/1053* (2013.01)

(58) Field of Classification Search
CPC ..... A45D 40/262; A45D 40/265; A46B 1/00; A46B 1/0238; A46B 3/005; A46B 9/021; A46B 2200/1053
See application file for complete search history.

(56) References Cited

U.S. PATENT DOCUMENTS 6,412,496 B1 † 7/2002 Gueret
6,581,610 B1 † 6/2003 Gueret
(Continued)

FOREIGN PATENT DOCUMENTS

DE 202011050794 U1 9/2011
FR 2937514 A1 4/2010
(Continued)

OTHER PUBLICATIONS

Aug. 12, 2016 Office Action issued in Chinese Patent Application No. 201480044059.9.
(Continued)

*Primary Examiner* — Rachel R Steitz
(74) *Attorney, Agent, or Firm* — Oliff PLC

(57) ABSTRACT

An applicator for applying a product to the eyelashes and/or eyebrows, including a molded application member, including: a core with a longitudinal axis, a plurality of longitudinal rows of teeth with a flattened cross-section, distributed about the core and each extending along the longitudinal axis of the core, each of the rows including consecutive teeth staggered along the core and partially superposed at their base in elevation, the teeth in elevation having a dissymmetrical shape with a convex edge.

17 Claims, 6 Drawing Sheets

(56) References Cited

U.S. PATENT DOCUMENTS

Figure 1:
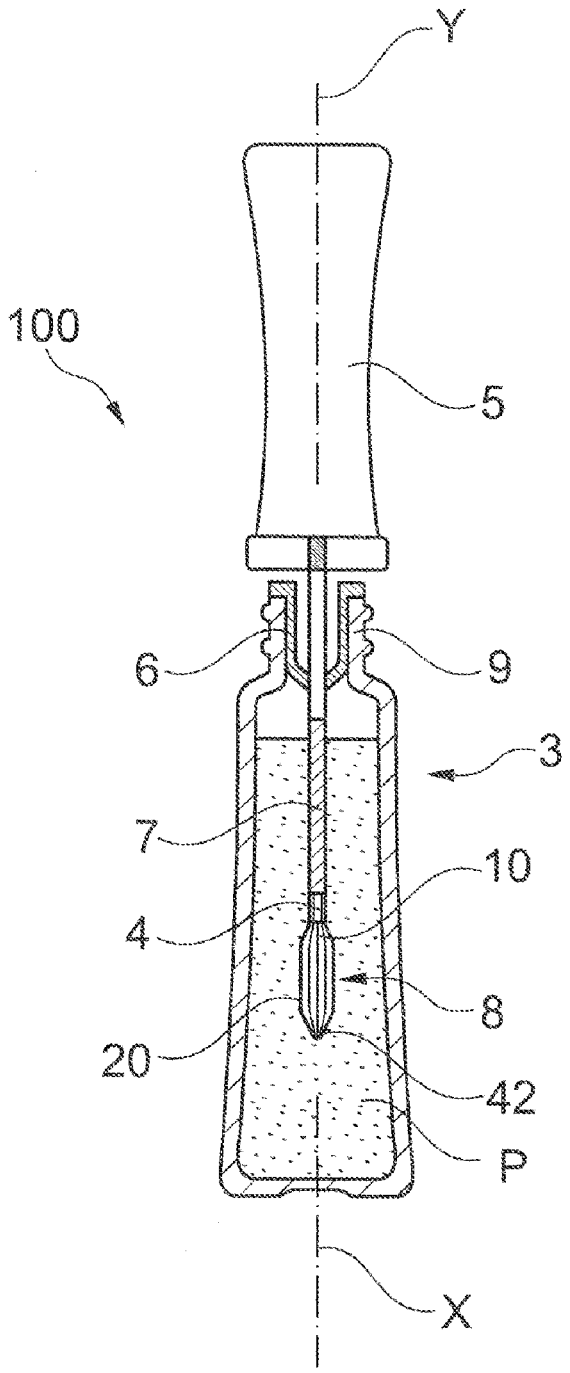

| | | | |
|---|---|---|---|
| 7,665,473 | B1 | 2/2010 | Gueret |
| 8,336,560 | B2 † | 12/2012 | Dumler |
| 2006/0002758 | A1 | 1/2006 | Gueret |
| 2009/0193602 | A1 | 8/2009 | Dumler et al. |
| 2009/0276973 | A1 | 11/2009 | Bouix et al. |
| 2010/0294297 | A1 | 11/2010 | Gueret |
| 2010/0307529 | A1 | 12/2010 | Schwab et al. |
| 2012/0039658 | A9 | 2/2012 | Gueret |

FOREIGN PATENT DOCUMENTS

| | | | |
|---|---|---|---|
| JP | 2001-145515 | A | 5/2001 |
| JP | 2003-259914 | A | 9/2003 |
| JP | 2006-051350 | A | 2/2006 |
| JP | 2006-087962 | A | 4/2006 |
| JP | 2008-006295 | A | 1/2008 |
| JP | 2009-183702 | A | 8/2009 |
| JP | 2010-536518 | A | 12/2010 |
| WO | 2012/011022 | A1 | 1/2012 |

OTHER PUBLICATIONS

Sep. 8, 2016 Third Party Observation issued in European Patent Application No. 20140731819.

Aug. 5, 2014 Search Report issued in International Patent Application No. PCT/IB2014/062007.

Partial Translation dated Aug. 5, 2014 Written Opinion issued in International Patent Application No. PCT/IB2014/062007.

Jan. 12, 2018 Office Action issued in Japanese Application No. 2016-517727.

Jun. 6, 2018 Office Action issued in Japanese Application No. 2016-517727.

† cited by third party

APPLICATOR FOR APPLYING A PRODUCT TO THE EYELASHES AND/OR EYEBROWS

The present invention relates to an applicator for applying a product to the eyelashes and/or eyebrows, having a molded applicator member, and to a packaging and application device having such an applicator.

A large number of applicators having an applicator member that has a core and teeth molded in one piece with the core have already been proposed.

EP 1 070 466 discloses a comb having a row of teeth disposed in staggered rows, which are partially or entirely superposed.

Application FR 2 962 888 discloses a brush having teeth disposed in staggered rows, with a symmetrical shape in front view.

Application EP 1 070 465 discloses a comb having teeth with an asymmetrical shape in front view, said teeth being partially or entirely superposed and having a flattened base.

There is a need to further improve applicators having a molded applicator member in order to allow the user to apply makeup such that the eyelashes are loaded and separated as effectively as possible.

There is also a need to benefit from an applicator that makes it possible to apply makeup to the eyelashes or eyebrows, which are or are not already coated with product, by bunches.

SUMMARY

A subject of the invention, according to one of its aspects, is an applicator for applying a product to the eyelashes and/or eyebrows, having a molded applicator member having:

a core having a longitudinal axis, a plurality of longitudinal rows of teeth with a flattened cross section which are distributed around the core and each extend along the longitudinal axis of the core, each of the rows having consecutive teeth that are disposed in staggered rows along the core and are superposed partially at their base in front view, the teeth having an asymmetrical shape in front view and the teeth also having a convex edge in front view.

The applicator constitutes a brush on account of the plurality of longitudinal rows of teeth.

The particular shape of the teeth, which is flattened, asymmetrical in front view and has a convex edge allows better retention of product, and makes it possible to have a relatively large contact surface between the eyelashes and the teeth, this making it possible to properly load the eyelashes with product during application. The flattening of each of the teeth is substantially transverse to the core so as to promote the separation of the row of eyelashes, to produce, during application or combing, a multitude of bunches of eyelashes that are well defined, and to prevent the formation of excessively large clumps of eyelashes.

The particular distribution of the teeth within a row, namely the distribution in staggered rows and the partial superposition, in front view, of the teeth, makes it possible to increase the area of contact of the eyelashes with the product present on the teeth.

The invention makes it possible to obtain, if so desired by the user, a makeup result with the eyelashes and/or eyebrows in bunches, that is to say with the eyelashes grouped in small distinct clumps, thereby organizing the eyelashes and giving them volume.

A tooth is seen in front view when it is seen along the longitudinal axis of the core in projection on a plane perpendicular to the longitudinal axis of the core.

The expression "longitudinal axis of the core" denotes the line connecting all of the centers of mass of the cross sections of the core. The longitudinal axis may be a central axis, or even an axis of symmetry for the core, in particular when the core has a circular cross section or a cross section in the overall shape of a regular polygon. The longitudinal axis of the core may be rectilinear or curved and may be contained in a plane, which may be a plane of symmetry for some, or even for all of the cross sections of the core. Preferably, the longitudinal axis of the core is rectilinear.

The expression "longitudinal row of teeth" denotes a succession of teeth in the longitudinal direction. Preferably, the rows all extend along respective longitudinal axes that are parallel to the longitudinal axis of the core.

The expression "tooth" denotes an individualizable projecting element that is used to apply the product and to separate the eyelashes and is produced in accordance with the invention.

The expression "flattened cross section" should be understood as meaning that the tooth has, over at least a part of its height, a cross section, measured perpendicularly to its direction of elongation, which has an elongate shape in a flattening plane, that is to say is wider than it is thick. Preferably, the tooth is flattened in a direction perpendicular to the longitudinal axis of the core.

The expression "disposed in staggered rows" should be understood as meaning that the bases of two consecutive teeth in one and the same row are not exactly superposed when the applicator member is seen in front view, and are alternately offset on either side of a centre line.

The expression "a tooth having, in front view, an asymmetrical shape" denotes a tooth made such that, when it is seen in front view, the tooth does not have an axis of symmetry. Such a tooth preferably has left-hand and right-hand edges with different shapes.

The expression "convex edge" denotes an edge of the tooth, when it is seen in front view, that has a curvature rounded toward the outside of the tooth, in particular in the form of a portion of an ellipse, of a circle or of a parabola.

Preferably, the angular extension at the base of the tooth, at the junction with the core, defines the overall angular extension of the tooth about the longitudinal axis of the core. Preferably, the tooth is inscribed, in front view, in a rectangle with a width equal to the greatest transverse dimension of the tooth in front view.

The number of longitudinal rows may be greater than or equal to 4, better still greater than or equal to 6.

The number of teeth in a row of teeth is preferably between 10 and 100, better still between 20 and 50.

The height of the teeth in one row may increase overall with increasing distance from the distal end of the applicator along at least half the length of the row of teeth, better still along the entire length of the row of teeth.

The expression "increase overall" should be understood as meaning that the radius of the envelope surface of the applicator member, defined by the distal end of the teeth, increases with increasing distance from the distal end of the applicator, continuously or in steps.

As a variant, the height of the teeth in one row may decrease overall with increasing distance from the distal end of the applicator along at least half the length of the row of teeth, better still along the entire length of the row of teeth.

Each tooth in each of the rows may become thinner upward at least over a part of the height of the tooth, better still over the entire height of the tooth.

Each tooth in each of the rows may become thinner toward the edge situated on the outer side of said rows of teeth. The edge situated on the outer edge of said rows of teeth is preferably the convex edge.

Each tooth in each of the rows may have a flattened cross section over at least half of its height, better still its entire height or possibly only above a narrowing in its cross section near to the base of the tooth.

The convex edge may extend over at least half the height of the tooth, better still over the entire height of the tooth, specifically from the base to the free end of the tooth.

Each tooth in each of the rows preferably has a rectilinear edge preferably situated on the inner side of the row of teeth. The teeth become thinner in particular from the rectilinear edge to the edge situated on the outer side of the rows of teeth, in particular the convex edge.

As a variant, each tooth in each of the rows has a concave edge preferably situated on the inner side of the row of teeth. The teeth become thinner in particular from the rectilinear edge to the edge situated on the outer side of the rows of teeth, in particular the convex edge.

The convex edge may be an angular edge of each tooth and may constitute, in cross section through the tooth, a ridge.

The convex edge is preferably oriented toward the outside of the row of teeth.

The convex edges of adjacent teeth in a row are preferably oriented toward opposite sides of the row.

The teeth preferably extend from a single base, with a closed contour when seen along the axis of the tooth.

Preferably, the teeth are solid. The teeth may have a substantially pointed free end. The circumferential extension of each tooth about the core may be less than 180°, better still 90°.

Preferably, the teeth taper at their distal end so as to form a point. The tangents to the surface of each tooth in front view, taken at 90% of the total height of the tooth, may form an angle of less than or equal to 90° between one another. The ratio of the greatest width of the tooth to its height is preferably between 0.5 and 2.

The teeth of even rank in each of the rows may be aligned with one another and form a first alignment in the longitudinal direction, and the teeth of odd rank in each of the rows may be aligned with one another and form a second alignment in the longitudinal direction.

The teeth of even rank are preferably identical to one another. Similarly, the teeth of odd rank are preferably identical to one another.

The teeth of the same rank in each of the alignments may be different, in particular have different heights and/or different orientations. As a variant, the teeth of the same rank in each of the alignments are identical.

Preferably, in front view, the first alignment is the mirror image of the second alignment with respect to a plane parallel to the longitudinal axis of the core, along at least half the length of the row of teeth in question, better still along the entire length of the row of teeth.

The ratio m/n of the heights between two adjacent teeth may be between 0.1 and 0.9, m being the height of the shorter tooth of the two adjacent teeth and n being the height of the longer tooth. The teeth in the first alignment are thus larger or smaller than the teeth in the second alignment.

As a variant, the height of the teeth may vary in an alternating manner per batch of teeth, each batch being constituted in particular by two teeth with the same height.

The core may have a circular or polygonal, in particular hexagonal, cross section. The teeth in each of the alignments may be attached at their base to one and the same flat face of the core over more than half of their greatest width. Preferably, the teeth in each of the alignments extend over virtually their entire width, at their base, from one and the same flat face of the core.

Each row of teeth may extend from a ridge of the core, the teeth in the second alignment extending from the face situated on one side of the ridge and the teeth in the first alignment extending from the face situated on the other side. Preferably, the second alignment is symmetrical, in front view, with the first alignment with respect to the plane defined by the longitudinal axis of the core and by said ridge. As a variant, the two alignments are not symmetrical in front view.

The rows may be at least partially superposed in front view, in particular at their base. The teeth in the first alignment of each of the rows may be superposed, in particular at their base, in front view, on the teeth in the second alignment of one of the adjacent rows. As a variant, the teeth in the first alignment of each of the rows are not superposed, in front view, on the teeth in the second alignment of the adjacent rows.

The applicator member may have a plurality of rows of spikes between the rows of teeth. Each spike may be interposed between the teeth of one row of teeth when the applicator member is seen from the side, preferably with an alternation of spikes and teeth between a row of teeth and an adjacent row of spikes. Each row of spikes may be at least partially, better still entirely superposed, in front view, with at least one row of teeth.

The applicator member preferably has at least one, better still two rows of spikes between two circumferentially consecutive rows of teeth.

A further subject of the invention is a packaging and application device having:

an applicator according to the invention, as defined above, a container containing a product to be applied to the eyelashes or eyebrows with the aid of the applicator.

A further subject of the invention is a method for making up the eyelashes and/or eyebrows with the aid of an applicator according to the invention.

The product to be applied may be a mascara or a care product.

Figure 2:
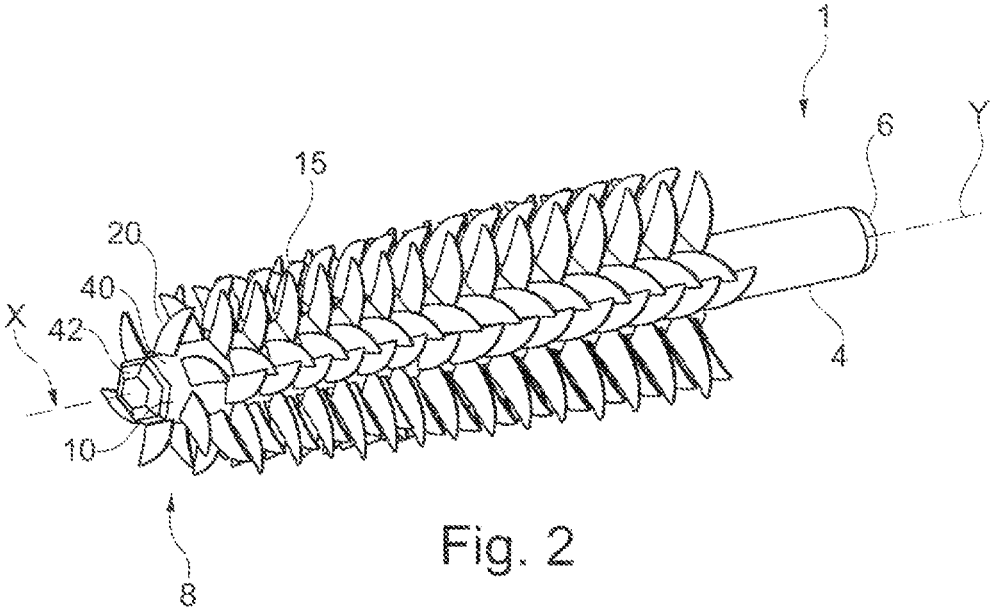
Figure 3:
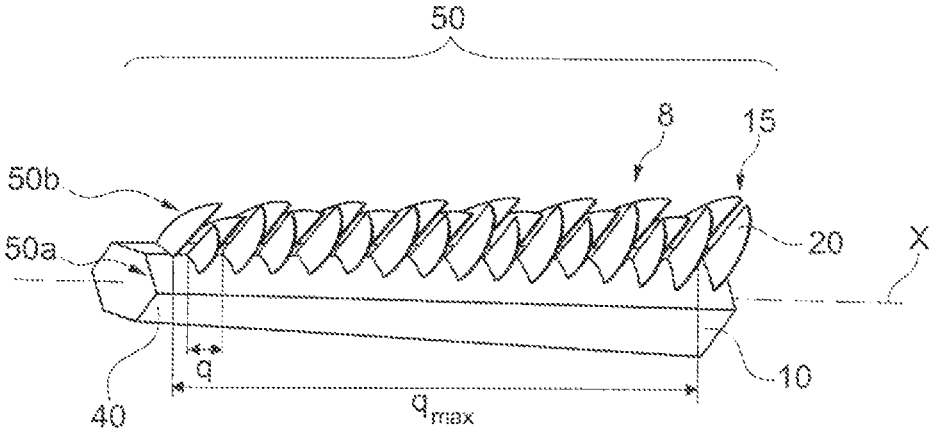
Figure 4:
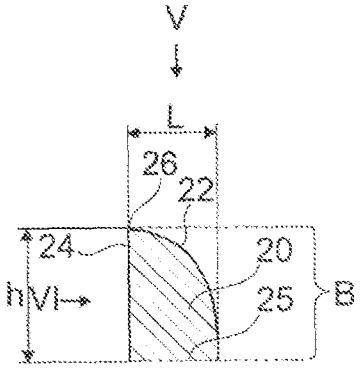
Figure 5:
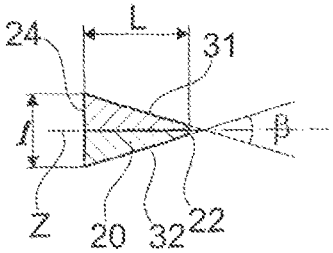
Figure 6:
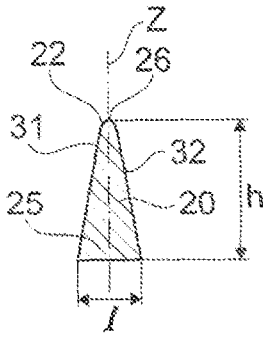
Figure 7A:
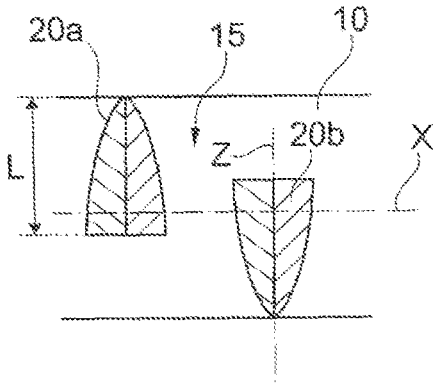
Figure 7B:
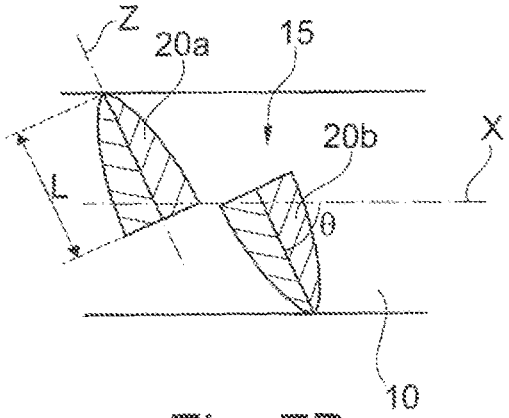
Figure 8:
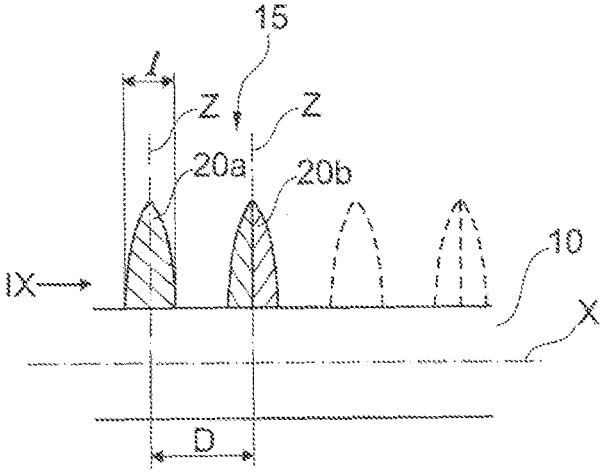
Figure 4A:
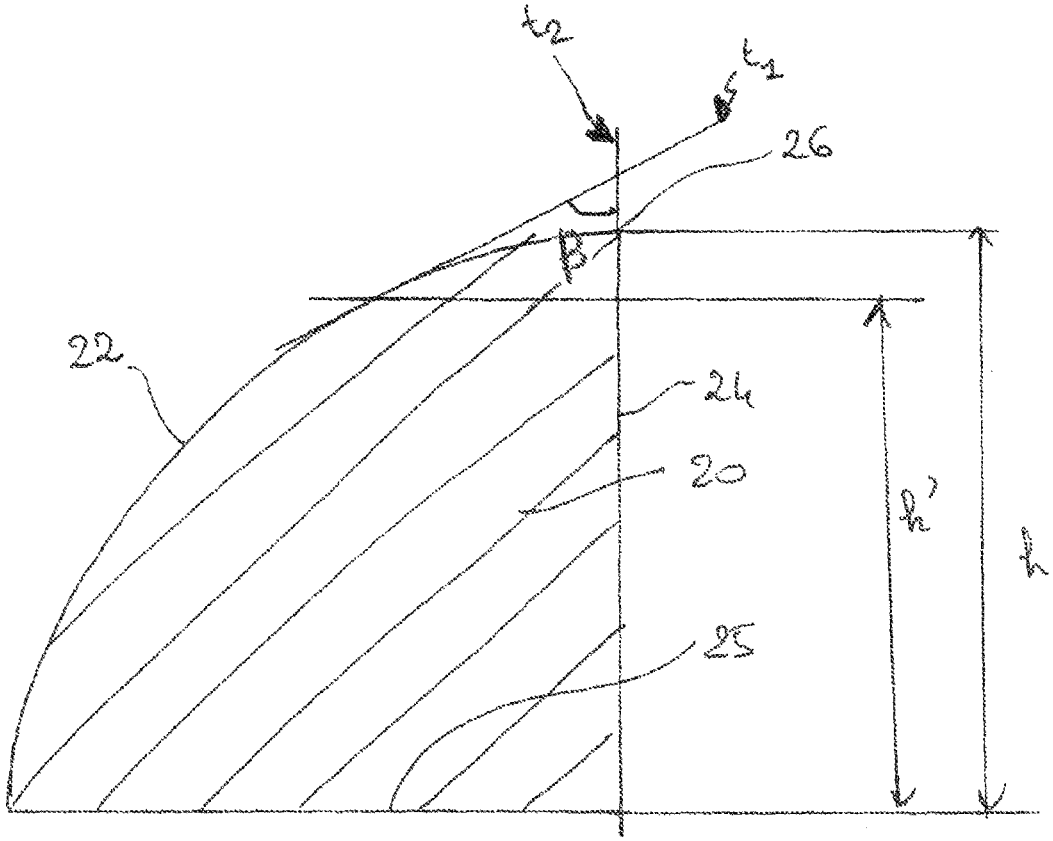
Figure 9:
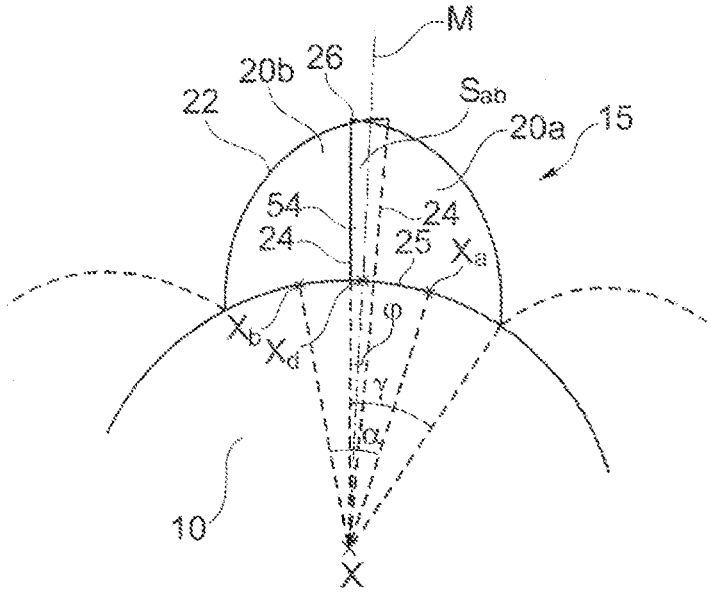
Figure 10A:
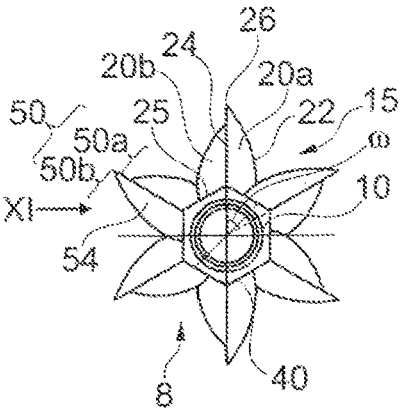
Figure 10B:
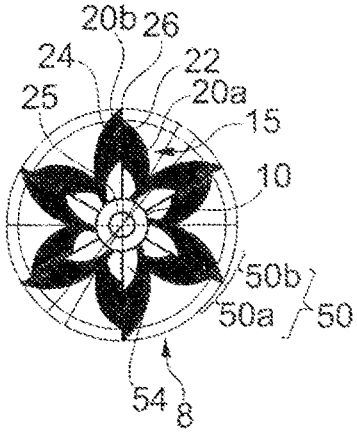
Figure 11:
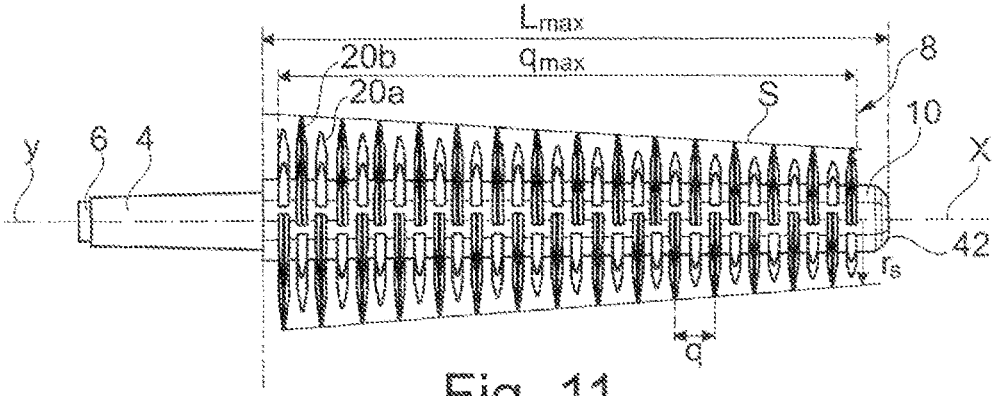
Figure 12:
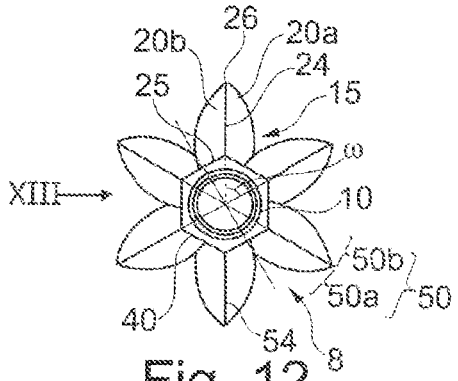
Figure 13:
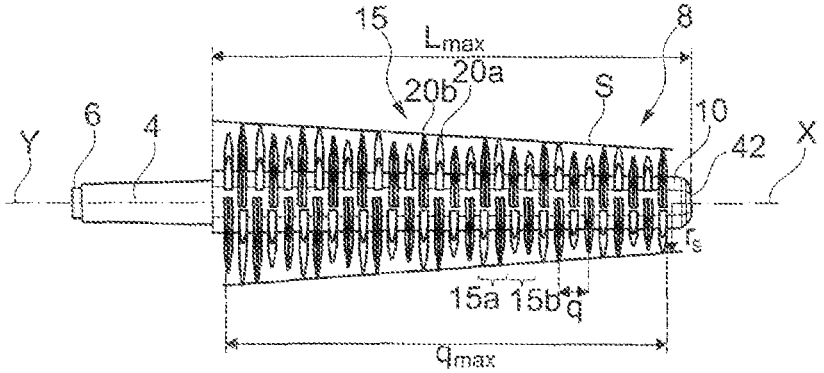
Figure 14:
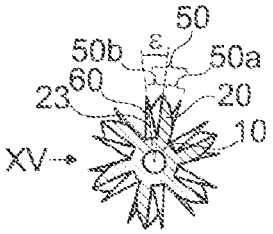
Figure 15:
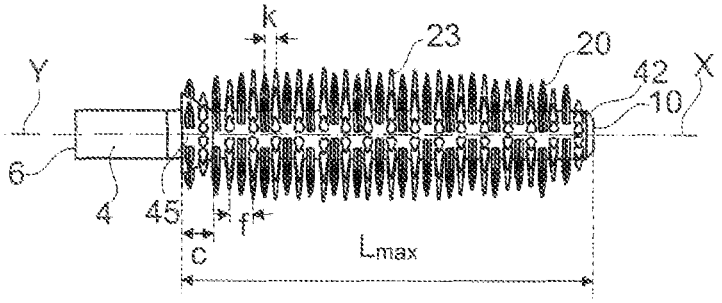
Figure 16:
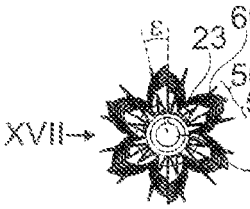
Figure 17:
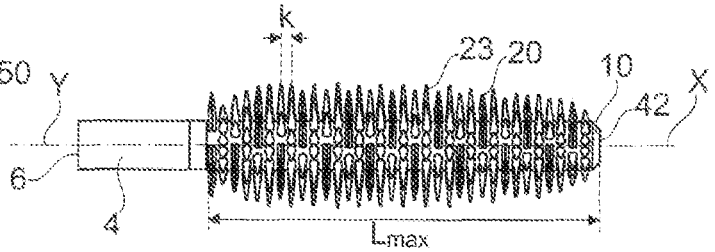

The invention may be better understood on reading the following detailed description of nonlimiting illustrative examples thereof and on examining the appended drawing, in which:

FIG. 1 is a schematic view, in longitudinal section, of an example of a packaging and application device produced in accordance with the invention, FIG. 2 is a schematic perspective view of an applicator member according to one illustrative example of the invention, FIG. 3 shows a row of teeth of the applicator member from FIG. 2 on its own, FIG. 4 is a schematic front view of a tooth, FIG. 4A is a schematic front view of an example of a tooth according to the invention, FIG. 5 is a view along V in FIG. 4, FIG. 6 is a view along VI in FIG. 4, FIGS. 7A and 7B are examples of the disposition of teeth on the core, seen in a top view, FIG. 8 is a schematic side view illustrating the relative positioning of successive teeth, FIG. 9 is a front view along IX in FIG. 8, FIGS. 10A and 10B are schematic front views of applicator members according to the invention, FIG. 11 is a view along XI in FIG. 10A, FIG. 12 shows a front view of a variant of an applicator member according to the invention, FIG. 13 is a side view along XIII in FIG. 12, FIG. 14 is a view similar to FIG. 12 of a variant applicator member, FIG. 15 is a side view along XV in FIG. 14, FIG. 16 is a view similar to FIG. 12 of a variant applicator member, and FIG. 17 is a side view along XVII in FIG. 16.

FIG. 1 shows a packaging and application device 100 having a container 3 containing a product P to be applied to the eyelashes and/or eyebrows and an applicator 1 for applying said product P. The applicator 1 has an applicator member 8 according to the invention, which is connected by a stem 7 to a gripping member 5 which also constitutes a member for closing the container 3. This closure member 5 is, for example, as illustrated, a cap designed to be screwed onto a neck 9 of the container. The container 3 may have a wiping member 6 for wiping the applicator 1, fixed in the neck 9 of the container 3.

The applicator member 8 has a core 10 bearing application elements 20 which are constituted by teeth according to the invention, and spikes, if need be.

If need be, the stem 7 may have an annular narrowing at its portion that is positioned opposite the lip of the wiping member 6, so as not to mechanically stress the latter unduly during storage.

The applicator member 8 may be connected to the stem 7 in various ways and has for example, as illustrated in FIG. 2, an end piece 4 designed to be fixed in a housing thereof.

The applicator member 8 may be fixed to the stem 7 by any means, and in particular by force-fitting, stapling, snap-fastening, adhesive bonding, welding or crimping, in the corresponding housing provided at the end of the stem 7.

As a variant, the stem 7 may be inserted into a housing provided in the core 10, or the stem and the core may be produced at least partly in one piece.

Core

As illustrated in FIGS. 2 and 3, the core has an elongate shape along a longitudinal axis X, which may be rectilinear or curved, preferably being rectilinear.

As illustrated in FIG. 10A, the core 10 may have a polygonal, in particular hexagonal, cross section along the majority of its length, the sides of the core 10 defining longitudinal faces 40. The latter may all be provided with teeth 20. The faces 40 are preferably flat, as in the example illustrated, but could be curved as a variant. In one variant, which is not illustrated, only a part of the faces 40 of the core 10 bears teeth 20.

As a variant, and as illustrated in FIG. 10B, the core 10 may have a circular cross section along the majority of its length.

As illustrated, the longitudinal axis X may be central and the core 10 may be inscribed in cross section in a circle having a diameter less than or equal to 5 mm.

As illustrated in FIGS. 2 and 3, the cross section of the core may widen in the direction of the end piece 4. As a variant, the cross section of the core becomes thinner in the direction of the end piece 4. As a variant, the core 10 may have a constant cross section, and in particular have a cylindrical shape.

The core 10 may be hollow, the inside diameter of the core 10 preferably being between 1 mm and 2.5 mm.

At its distal end 42, the core 10 may have a head which is beveled so as to make it easier to return the applicator 1 into the container 3.

According to the variant illustrated in FIG. 15, the core 10 has a widened portion 45 in the form of a cone on the side of the end piece 4, at its proximal end. This portion 45 has application elements, in particular teeth 20 and spikes 23. The axial dimension c of this conical portion 45 may be between 1 mm and 5 mm. The conical portion 45 may have at least one tooth 20 in each row 50 as described below and at least one spike 23 in each row 60 as described below.

The conical portion 45 has, at its end adjacent to the stem 7, a diameter more or less equal to the outside diameter of the stem 7.

The core 10 may be made of a thermoplastic material which is or is not relatively rigid, for example SEBS, a silicone, latex, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, PET, POM, PA or PMMA. It is possible in particular to use the materials known under the trade names Hytrel®, Cariflex®, Alixine®, Santoprene®, or Pebax®, this list not being limiting.

The core 10 may be produced in one piece with the stem 7 by being molded together therewith.

In one variant, which is not illustrated, the core 10 is twisted, the teeth 20 then following the twist produced by the core.

Teeth

The applicator member 8 has teeth 20 which each extend toward the outside from the core 10, in the direction of a free end 26.

Shape of the Teeth

As illustrated in the figures, the teeth in at least one row of teeth 20, and better still, as illustrated in FIG. 2, all of the teeth 20, have a convex edge 22 in front view. Said convex edge may, as illustrated in FIG. 4, be a portion of a curve, in particular a portion of a circle or of a parabola, and preferably a portion of an ellipse.

The convex edge 22 may extend over more than half the height h of each of the teeth 20, better still over the entire height h of each of the teeth 20, as illustrated in FIG. 4.

Each tooth 20 may become thinner toward the convex edge 22, as illustrated in FIG. 5. In cross section, the vertex angle β formed between the opposite main faces 31 and 32 of the tooth 20 may be less than or equal to 40°, better still less than or equal to 15°. This thinning allows the eyelashes to be displaced as soon as they come into contact with the applicator 1. As illustrated in FIG. 4, each tooth 20 may become thinner upward, in front view, over at least a part B of its height, better still at least half of its height. The part B may extend from the base 25. The major dimension of the base 25 is for example between 0.3 mm and 3 mm. Preferably, the free end 26 of each tooth is tapered in front view, as illustrated in FIG. 4, in particular forming a point which facilitates penetration into the eyelashes and the separation of the latter.

As illustrated in FIG. 5, each tooth 20 has a flattened cross section over a part of its height, better still over more than half of its height, even better still over its entire height. The flattening plane Z of the teeth 20 is preferably oriented more or less perpendicularly to the core 10. The flattening plane Z is preferably a median plane of symmetry for the tooth 20.

As illustrated in FIGS. 4 and 5, each tooth 20 may have, in front view, a rectilinear edge 24, which is in particular radial with respect to the longitudinal axis X of the core 10, and extends over more than half the height h of the tooth 20, preferably over the entire height h of the tooth 20.

Preferably, as illustrated in FIG. 4, the tooth 20 is inscribed, in front view, in a rectangle with a width substantially equal to the greatest transverse dimension L of the tooth 20 in front view.

Preferably, each tooth 20 has an angular extent γ which is equal to the angular extent of the base of the tooth 25.

Each tooth 20 preferably has, as illustrated in particular in FIG. 5, a flat face 24 which defines this rectilinear edge. The flat face 24 is away from the convex edge 22 of the tooth 20. Preferably, each tooth 20 becomes thinner from the flat face 24 to the convex edge 22. Preferably, the latter defines a ridge.

Each tooth 20 may have two opposite main longitudinal faces 31 and 32 which are flat or curved, being concave or preferably, as illustrated in FIG. 5, convex toward the outside. As illustrated in FIG. 5, the faces 31 and 32 are preferably portions of an ellipsoid.

As illustrated in FIG. 5, the faces 31 and 32 are preferably the same shape. In the examples illustrated, the faces 31 and 32 connect the flat face 24 to the convex edge 22.

The greatest width L of each tooth 20, defined as the largest dimension of the tooth 20 on the flattening plane Z, may be between 0.3 mm and 3 mm, better still between 0.5 mm and 1.5 mm. This greatest width L is preferably measured from the base of the teeth 20, as illustrated in FIG. 4.

The height h of each tooth 20 may be between 0.5 mm and 1 cm, better still between 1 mm and 5 mm. The maximum thickness/of each tooth 20 may be between 0.2 mm and 1 mm, better still between 0.4 mm and 1.5 mm. This maximum thickness/may be measured at the base of the teeth 20. The thickness of each tooth 20 at its free end 26 may be less than or equal to 0.5 mm.

Preferably, the teeth 20 are solid. As a variant, the teeth 20 may have an orifice which is or is not a through-orifice.

The teeth 20 may extend from a single base 25 with a closed contour. The circumferential extension γ of the teeth on the core may be less than or equal to 180°, better still less than or equal to 90°.

Preferably, as illustrated in FIG. 4A, the teeth 20 taper at their distal ends 26 so as to form a point. Preferably, the tangents $t_1$ and $t_2$ to the surface of the tooth 20, in front view, taken at a height h' equal to 90% of the height h of the tooth 20, form an angle β less than or equal to 90°.

The ratio L/h of the greatest width L of the tooth 20 to the height h of the tooth 20 should be between 0.5 and 2.

The teeth 20 are preferably made of the same material as at least a part of the core 10, better still all of the core 10. The teeth 20 are preferably produced in one piece with the core 10 by molding of thermoplastic material.

As a variant, each tooth 20 does not become thinner over its entire height. Each tooth 20 may then have, over a part A of its height, a region with a constant width or a width that increases upward. This part A has a height which is preferably less than half the height h of the tooth 20.

As illustrated in FIG. 7B, the flattening plane Z may be oriented obliquely with respect to the longitudinal axis X of the core 10 at an angle θ of between 45° and 90°.

In a variant that is not illustrated, the median axis of the flat face 24 does not extend perpendicularly to the axis X but obliquely with respect thereto, toward the front, that is to say toward the distal end of the applicator, or toward the rear.

The teeth 20 and the core 10 may be made of different materials, if need by, by bi-injection-molding. The teeth 20 are for example molded through openings in the core 10. The teeth 20 may be produced from a material softer than the core or, as a variant, harder than the core.

Arrangement of Two Successive Adjacent Teeth

As illustrated in the figures, the core 10 may have on its surface at least one row of pairs 15 of adjacent teeth, even better still, as illustrated in FIG. 2, a plurality of rows of pairs 15 of adjacent teeth, such as the teeth 20 described above. As can be seen in FIG. 8, the teeth 20*a* and 20*b* of each pair 15 of adjacent teeth are offset axially by a distance D, the latter being the distance between the flattening planes Z of the two teeth 20*a* and 20*b*. The distance D may be between 0.5 mm and 3 mm.

As can be seen in FIGS. 7A and 9, the adjacent teeth 20*a* and 20*b* are offset about the longitudinal axis X of the core 10. The angular spacing α between the two teeth 20*a* and 20*b*, which is defined, in front view, by the angle α between the radius of the core 10 passing through the middle $X_a$ of the arc of intersection of the teeth 20*a* with the core 10 and the radius of the core 10 passing through the middle $X_b$ of the arc of intersection of the teeth 20*b* with the core 10, is preferably between 5° and 60°.

The two adjacent teeth 20*a* and 20*b* can be the same height, as illustrated in FIG. 12, or have different heights, as illustrated in particular in FIG. 10A. This latter figure shows that each tooth 20*a* is slightly higher than each adjacent tooth 20*b*, which is situated in front of it, that is to say which is closer to the distal end 42 of the applicator.

As illustrated in FIG. 9, the convex edge 22 of the teeth 20*a* can be oriented to the right in front view, while the convex edge 22 of the teeth 20*b* can be oriented to the left, or vice versa. This opposite orientation of the convex edges 22 makes it possible for the brush to be used in either direction while producing the same effect.

The adjacent teeth 20*a* and 20*b* can be superposed at least partially, in particular at their base 25, and over at least a part of the height h of the two teeth 20*a* and 20*b*, better still, as can be seen in FIG. 9, over the entire height of at least one of the teeth 20*a* or 20*b*. The angular spacing α between the two teeth 20*a* and 20*b* is less than the angular extents γ taken up by each of the teeth 20*a* and 20*b*, these angular extents being defined by the angle taken up by the teeth at their base. As illustrated in FIG. 9, the angle of overlap φ defined, in front view, as the angle taken up by the area of superposition $S_{ab}$ between the two teeth 20*a* and 20*b* about the longitudinal axis X, i.e. γ-α, may be less than or equal to 5°.

As illustrated in FIGS. 10A, 10B and 11, each tooth 20*a* may be larger than each adjacent tooth 20*b*, or vice versa. The ratio m/n of the heights is preferably between 0.1 and 0.9, m being the height of the small tooth and n being the height of the large tooth.

As illustrated in FIGS. 9 and 12, the teeth 20*a* and 20*b* may be the same height, the first tooth 20*a* preferably being, in front view, the mirror image of the second tooth 20*b* with respect to a plane of symmetry M parallel to the longitudinal axis X of the core 10.

Rows of Teeth

As illustrated in the figures, the applicator member 8 may have at least one row 50 of pairs 15 of teeth, better still a plurality of rows 50 of pairs 15 of teeth, the pairs 15 of teeth having teeth 20*a* and 20*b* as described above. The rows 50 preferably extend along the longitudinal axis X of the core 10.

The applicator member 8 may have at least two rows 50 of pairs 15 of teeth, better still at least four rows 50, even better still at least six rows 50 disposed around the longitudinal axis X of the core 10.

All the rows 50 of the applicator member 8 are preferably identical.

The teeth of each of the rows 50 preferably have the same abscissa, along the longitudinal axis X, as the teeth of the same rank in the adjacent rows 50. Thus, the teeth of the same rank appear to be aligned when the applicator member is seen from the side.

The rows 50 are preferably spaced apart regularly around the longitudinal axis X of the core 10.

As illustrated in FIGS. 10A and 10B, the angular spacing ω between two consecutive rows 50, around the longitudinal axis X of the core 10, is preferably constant, the angular spacing co being defined, in front view, by the angle between the radii of the core 10 which pass through the centers of mass of said rows. The angular spacing co is preferably between 15° and 95°, better still between 45° and 75°, even better still equal to 60°.

Such rows 50 can be referred to as "double rows" on account of the presence of two distinct alignments 50*a* and 50*b* of respective teeth 20*a* and 20*b*, the teeth 20*a* and 20*b*, respectively, being aligned with one another when the applicator member 8 is seen in front view along its longitudinal axis X.

As illustrated in FIG. 13, the axial distance q between two consecutive pairs 15 of teeth in the row 50 is preferably constant and between 0.8 mm and 4 mm, the axial distance q being defined by the distance, in side view, between the flattening planes Z of the first teeth 20*a* within the alignment 50*a* of teeth 20*a*.

When the core has a hexagonal cross section, as illustrated in FIG. 10A, the applicator member 8 preferably has six double rows 50, each double row 50 having its longitudinal axis disposed along a ridge of the core 10. The teeth 20*a* extend over almost all of their base 25 over one of the flat faces 40 of the core 10, attached to said ridge. The teeth 20*a* extend, over almost all of their base 25, over the other flat face 40, being attached to said ridge.

The envelope surface S of the applicator member 8, defined by the free end 26 of the teeth 20, may be a surface of revolution, in particular a conical surface.

The radius $r_S$ of the envelope surface S preferably increases substantially in the direction of the end piece 4 along almost the entire length qmax of the row 50.

Preferably, as illustrated in FIG. 13, each alignment 50*a* and 50*b* has large teeth which alternate with small teeth, which are less high than the large teeth. The teeth of even rank of each alignment 50*a* and 50*b* are for example smaller than the teeth of odd rank, or vice versa. The ratio of the heights m/n is preferably between 0.6 and 0.9, m being the height of the small tooth and n being the height of the large tooth.

Each tooth of odd rank in the first alignment 50*a* is preferably the same height h as the adjacent tooth of even rank in the second alignment 50*b*. Each tooth of even rank in the first alignment 50*a* is preferably the same height h as the adjacent tooth of odd rank in the second alignment 50*b*. The teeth 20*a* and 20*b* are thus the same size for each pair of adjacent teeth in the double row 50.

Preferably, for each double row 50, the first alignment 50*a* is superposed, in particular at its base at 54, as illustrated in FIGS. 10A and 9, with the second alignment 50*b* of an adjacent double row 50. It is possible for this superposition to have only a small angular extent. The angle of overlap co, defined, in front view, as the angle taken up by the area of superposition $S_{ab}$ between the two teeth 20*a* and 20*b* of the two alignments 50*a* and 50*b* with respect to the longitudinal axis X, may be less than or equal to 45°.

As a variant, in front view, the teeth in adjacent rows 50 are not superposed.

The angular spacing co between two consecutive rows 50, around the longitudinal axis X of the applicator member 8, may also, in a variant that is not illustrated, vary around the core 10.

As illustrated in FIG. 11, the pairs 15 of teeth may have an increasing height with respect to one another along the longitudinal axis of the core along almost the entire length $q_{max}$ of the row 50. The teeth 20*a* and 20*b* in each alignment 50*a* and 50*b* may have an increasing height h with increasing distance from the distal end 42 of the applicator member 8, the teeth 20*a* in the first alignment 50*a* being smaller than the teeth 20*b* in the second alignment 50*b* of the same rank, or vice versa.

The distance D between two adjacent teeth 20*a* and 20*b* in one row 50 may be variable along at least half the length $q_{max}$ of the row 50.

The rows 50 of the applicator member 8 may differ from one another. The shape of the teeth 20*a* and 20*b* in two adjacent rows 50 may vary substantially, in particular by the height h of the corresponding teeth 20*a* and 20*b*. The teeth in one row 50 may all be larger than the teeth of the same rank in one of the adjacent rows 50.

As a variant, the teeth 20*a* and 20*b* of the same rank in adjacent rows 50 are not aligned about the longitudinal axis X when the applicator member is seen perpendicularly to the longitudinal axis of the core. The teeth 20*a* and 20*b* of the same rank in adjacent rows 50 may be offset along the longitudinal axis X.

As a variant, the teeth may form batches of adjacent teeth of the same height, the height of the adjacent batches of teeth alternating along the longitudinal axis X. The batches may each be formed of at least three teeth.

Spikes

As illustrated in FIGS. 15 to 18, the applicator member may have, in addition to the rows 50 of teeth, at least one row 60 of spikes, better still a plurality of rows 60 of spikes.

Spikes

Each of the spikes 23 in each of the rows 60 extends radially with respect to the core 10.

The spikes 23 preferably have a circular cross section but may have some other cross section, in particular a polygonal cross section.

The spikes 23 taper toward their free end, having for example a conical shape, as illustrated in FIG. 15.

The cross sections of the spikes 23 may all be inscribed in a circle having a diameter less than or equal to 0.8 mm, better still less than or equal to 0.65 mm. The base of the spikes 23 may be less wide than the greatest width of the teeth.

The height of the spikes 23 is for example between 0.5 mm and 4 mm.

The spikes 23 are preferably produced in one piece of the same material with the core 10 by molding of thermoplastic material.

The spikes 23 and the core 10 may also, as a variant, be made of different materials, if need by, by bi-injection-molding. The spikes 23 are for example molded through openings in the core 10. The spikes 23 may be produced from a material softer than the core or, as a variant, harder than the core. The spikes may be produced from a material softer than the teeth 20 or, as a variant, harder than the teeth 20.

Rows of Spikes

The applicator member 8 has at least two rows 60 of spikes, better still six rows 60, even better still twelve rows 60, as illustrated in FIGS. 15 to 18.

The rows 60 of adjacent spikes are preferably equidistant from one another on the core 10.

The number of spikes 23 in a row 60 is between 10 and 100.

In each of the rows 60, the spikes 23 are preferably aligned when the applicator member is seen along the longitudinal axis X.

The adjacent spikes 23 in each row 60 are preferably all spaced apart by the same distance f within a row 60, the distance f preferably being between 0.5 mm and 2 mm.

The spikes 23 in each of the rows 60 may be aligned with the spikes 23 of the same rank in the adjacent rows when the applicator member 8 is seen from the side. The rows 60 of spikes may have the same number of spikes 23, preferably being identical.

As illustrated, each row 60 of spikes is preferably disposed between at least two consecutive rows 50 of teeth, the spikes 23 being offset axially relative to the teeth 20.

Preferably, each of the rows 60 of spikes is not equidistant from the two rows 50 between which it is disposed.

As illustrated in FIGS. 14 and 16, the angular spacing c between the longitudinal axis of a row 50 of teeth and the longitudinal axis of a consecutive row 60 of spikes may be between 5° and 60°.

Preferably, the spikes 23 in each row 60 alternate longitudinally with the teeth 20 in each row 50.

The spikes 23 in each of the rows 60 may or may not be equidistant from two consecutive teeth 20 in one and the same row 50.

When the applicator member is seen from the side, the spikes 23 in each of the rows 60 may, as illustrated in FIGS. 15 and 17, all be disposed longitudinally at the same distance k from the tooth 20 which precedes them on the core 10, this distance k preferably being between 0.1 mm and 1 mm.

The height of the spikes 23 in each row 60 may increase from the end piece 4 to the distal end of the applicator member 8 along at least half the length of the row 60, better still along the entire length of the row 60.

As illustrated in FIGS. 14 and 16, the height of the largest spike 23 in the row 60 may be the same as that of the largest tooth 20 in an adjacent row 50.

As illustrated in FIGS. 14 to 17, two adjacent rows 50 may flank two rows 60.

Preferably, the spikes 23 in each of the rows 60 are superposed at least partially, in front view, on the teeth 20 of one of the adjacent rows 50, as illustrated in FIG. 14, or entirely, as illustrated in FIG. 15.

The angular spacing between two rows 60 is preferably between 10° and 90°, better still between 25° and 65°, even better still equal to 30°.

The invention is not limited to the exemplary embodiments which have just been described, the characteristics of which may be combined with one another as parts of variants which are not illustrated.

The applicator member may be able to vibrate, that is to say that vibrations may be applied to it during application, combing or picking up of the product.

As a variant, the applicator member may be able to rotate, that is to say that it may be made to carry out a rotational movement about the longitudinal axis of the core, for example during application, combing of the eyelashes or the picking up of the product.

As a further variant, the applicator member is heated, that is to say it may have a heating element for heating the eyelashes and/or eyebrows, and/or the teeth and/or the core of the applicator member.

The applicator member may also be able to vibrate and/or be able to rotate and/or be heated.

The expression "having a" should be understood as being synonymous with "having at least one", and "between" is understood as including the limits, unless specified to the contrary.

The invention claimed is:

1. An applicator for applying a product to the eyelashes and/or eyebrows, having a molded applicator member having:

a core having a circular or polygonal cross section and having a longitudinal axis, a plurality of longitudinal rows of teeth with a flattened cross section along a direction perpendicular to the longitudinal axis of the core, the plurality of longitudinal rows of teeth being distributed around the core and each extend along the longitudinal axis of the core, each of the longitudinal rows of teeth having consecutive teeth that are disposed in staggered rows along the core, the consecutive teeth being superposed partially at their base in front view, the base of a tooth being a junction of the tooth with the core, the teeth having an asymmetrical shape with a convex edge in front view, the adjacent rows being at least partially superposed in front view at their base.

2. The applicator as claimed in claim 1, each tooth having a rectilinear edge or a concave edge.

3. The applicator as claimed in claim 1, each tooth having a convex edge oriented toward the outside of the row.

4. The applicator as claimed in claim 1, the height of the teeth in one row increasing overall with increasing distance from the distal end of the applicator member along at least half the length $L_{max}$ of the applicator member.

5. The applicator as claimed in claim 1, the number of rows being greater than or equal to 4.

6. The applicator as claimed in claim 1, the number of teeth in one row being between 10 and 100.

7. The applicator as claimed in claim 1, the teeth in each of the rows becoming thinner both upward at least over a part A of the height h of the teeth and toward the edge situated on the outer side of said rows of teeth.

8. The applicator as claimed in claim 7, the teeth in each of the rows becoming thinner both upward at least over a part A of the height h of the teeth and toward the convex edge of said rows of teeth.

9. The applicator as claimed in claim 1, the teeth of even rank in each of the rows being aligned with one another and forming a first alignment, the teeth of odd rank in each of the rows being aligned with one another and forming a second alignment.

10. The applicator as claimed in claim 9, the first alignment not being identical to the second alignment.

11. The applicator as claimed in claim 9, the first alignment being the mirror image, in front view, of the second alignment with respect to a plane parallel to the longitudinal axis of the core.

12. The applicator as claimed in claim 1, the ratio of heights m/n between two adjacent teeth being between 0.6 and 0.9, m being the height of the shorter tooth of the two adjacent teeth and n being the height of the longer tooth.

13. The applicator as claimed in claim 1, the height of the teeth varying by batches of teeth of identical height.

14. The applicator as claimed in claim 1, the applicator member having a plurality of rows of spikes between the rows of teeth.

15. The applicator as claimed in claim 14, the spikes being interposed between the teeth of the rows of teeth when the applicator member is seen from the side.

16. The applicator as claimed in claim 14, the rows of spikes being superposed, in front view, at least partially with the rows of teeth.

17. A packaging and application device having an applicator as defined in claim 1 and a container containing the product to be applied.

* * * * *